US005899677A

United States Patent [19]

Ono et al.

[11] Patent Number: 5,899,677

[45] Date of Patent: May 4, 1999

[54] VANE COMPRESSOR HAVING A HIGH-PRESSURE SPACE FORMED IN THE CAM RING

[75] Inventors: Mitsuya Ono; Jin Ohsawa; Toshihiro Murayama, all of Kounan-machi, Japan

[73] Assignee: Zexel Corporation, Tokyo, Japan

[21] Appl. No.: 08/823,664

[22] Filed: Mar. 18, 1997

[30] Foreign Application Priority Data

Mar. 25, 1996 [JP] Japan ..... 8-095946

[51] Int. Cl.[6] ..... F04C 18/344

[52] U.S. Cl. ..... 418/133; 418/259

[58] Field of Search ..... 418/132, 133, 418/259

[56] References Cited

U.S. PATENT DOCUMENTS 4,822,263 4/1989 Nakajima et al. ..... 418/133

FOREIGN PATENT DOCUMENTS 58-148293 9/1983 Japan ..... 418/133

*Primary Examiner*—John J. Vrablik

*Attorney, Agent, or Firm*—Frishauf, Holtz, Goodman, Langer & Chick

[57] ABSTRACT

A vane compressor includes a rotor. The rotor is rotatably received in a cam ring. A first side member is secured to one end face of the cam ring. A second side member is secured to another end face of the cam ring. A high-pressure chamber is formed within the first side member. The cam ring has at least one high-pressure space formed therein which opens in the one end face of the cam ring in a manner such that the at least one high-pressure space directly communicates with the high-pressure chamber.

4 Claims, 4 Drawing Sheets

VANE COMPRESSOR HAVING A HIGH-PRESSURE SPACE FORMED IN THE CAM RING

BACKGROUND OF THE INVENTION

1. Field of the Invention

This invention relates to a vane compressor, and more particularly to a vane compressor which can be constructed in reduced size and weight without degrading the oil-separating capability of a discharge chamber thereof.

2. Description of the Prior Art

Conventionally, a vane compressor includes a cam ring, a rotor rotatably received within the cam ring, a drive shaft on which is secured the rotor, a front side block fixed to a front-side end face of the cam ring, a rear side block fixed to a rear-side end face of the same, a front head secured to a front-side end face of the front side block, a rear head secured to a rear-side end face of the rear side block, a plurality of axial vane slits formed in an outer peripheral surface of the rotor at circumferentially equal intervals, and a plurality of vanes radially slidably fitted in the axial vane slits, respectively. The drive shaft for rotating the rotor has opposite ends thereof rotatably supported by radial bearings arranged in the front and rear side blocks, respectively.

A discharge chamber is defined by an inner wall surface of the front head, the front-side end face of the front side block, and the front-side end face of the cam ring, into which flows refrigerant gas delivered from compression chambers.

After flowing into the discharge chamber, high-pressure refrigerant gas separates into gas and lubricant and the lubricant collects in a bottom of the discharge chamber.

In general, as the discharge chamber is made larger, the oil-separating capability of the discharge chamber is enhanced and high-pressure pulsation is reduced.

However, an increase in inner space of the front head made so as to increase the capacity of the discharge chamber leads to increases in size and weight of the front head as well as an increase in manufacturing costs of the compressor.

SUMMARY OF THE INVENTION

It is an object of the invention to provide a vane compressor having a discharge chamber having an increased in capacity without increasing the size and weight of a front head in which the discharge chamber is formed, thereby enhancing the oil-separating capability of the discharge chamber and reducing high-pressure pulsation.

To attain the object, the present invention provides a vane compressor including a rotor, a cam ring in which the rotor is rotatably received, a first side member secured to one end face of the cam ring, a second side member secured to another end face of the cam ring, and a high-pressure chamber formed within the first side member.

The vane compressor according to the invention is characterized in that the cam ring has at least one high-pressure space formed therein which opens in the one end face of the cam ring in a manner such that the at least one high-pressure space directly communicates with the high-pressure chamber.

According to the invention, the at least one high-pressure space, which directly communicates with the high-pressure chamber, serves as extended part of the discharge chamber, so that it is possible to increase the capacity of the high-pressure chamber without increasing the size and weight of the front head, and thereby enhance oil-separating capability of the high-pressure chamber and reduce high-pressure pulsation. Further, it is possible to reduce the size and weight of the front head without decreasing the capacity of the high-pressure chamber.

Preferably, the first side member comprises a side block and a head secured to the one end face of the cam ring in a manner such that the head encloses the side block, the high-pressure chamber being formed in the head in a manner such that the high-pressure chamber opens toward the cam ring to form an opening in a cam-ring side end face of the head, the at least one high-pressure space being formed in the cam ring such that the at least one high-pressure space opens in portions of the one end of the cam ring which correspond in position to the opening of the high-pressure chamber.

More preferably, the at least one high-pressure space is formed by a plurality of high-pressure spaces formed in the cam ring at circumferentially-spaced intervals.

According to the preferred embodiment, it is possible to decrease thick portions of the cam ring in number and volume, and at the same time facilitate production of a multi-cavity mold which permits a plurality of cam rings to be manufactured at one time by die-casting.

The above and other objects, features and advantages of the present invention will become more apparent from the following detailed description taken in conjunction with the accompanying drawings.

DETAILED DESCRIPTION OF THE PREFERRED EMBODIMENT

Next, the invention will now be described in detail with reference to drawings showing a preferred embodiment thereof.

Figure 1:
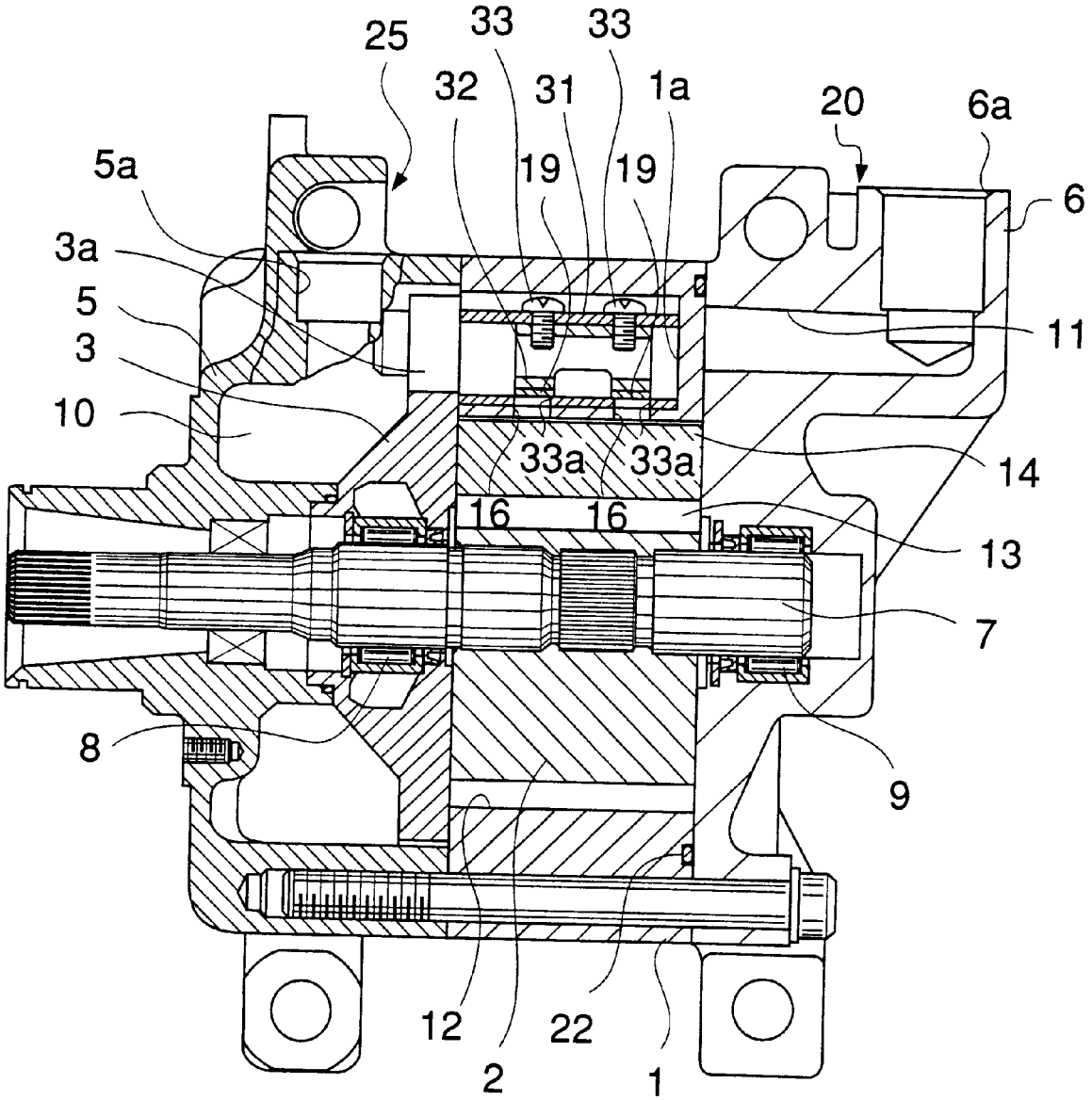
FIG. 1 is a longitudinal cross-sectional view showing the whole arrangement of a vane compressor according to an embodiment of the invention.
Figure 2:
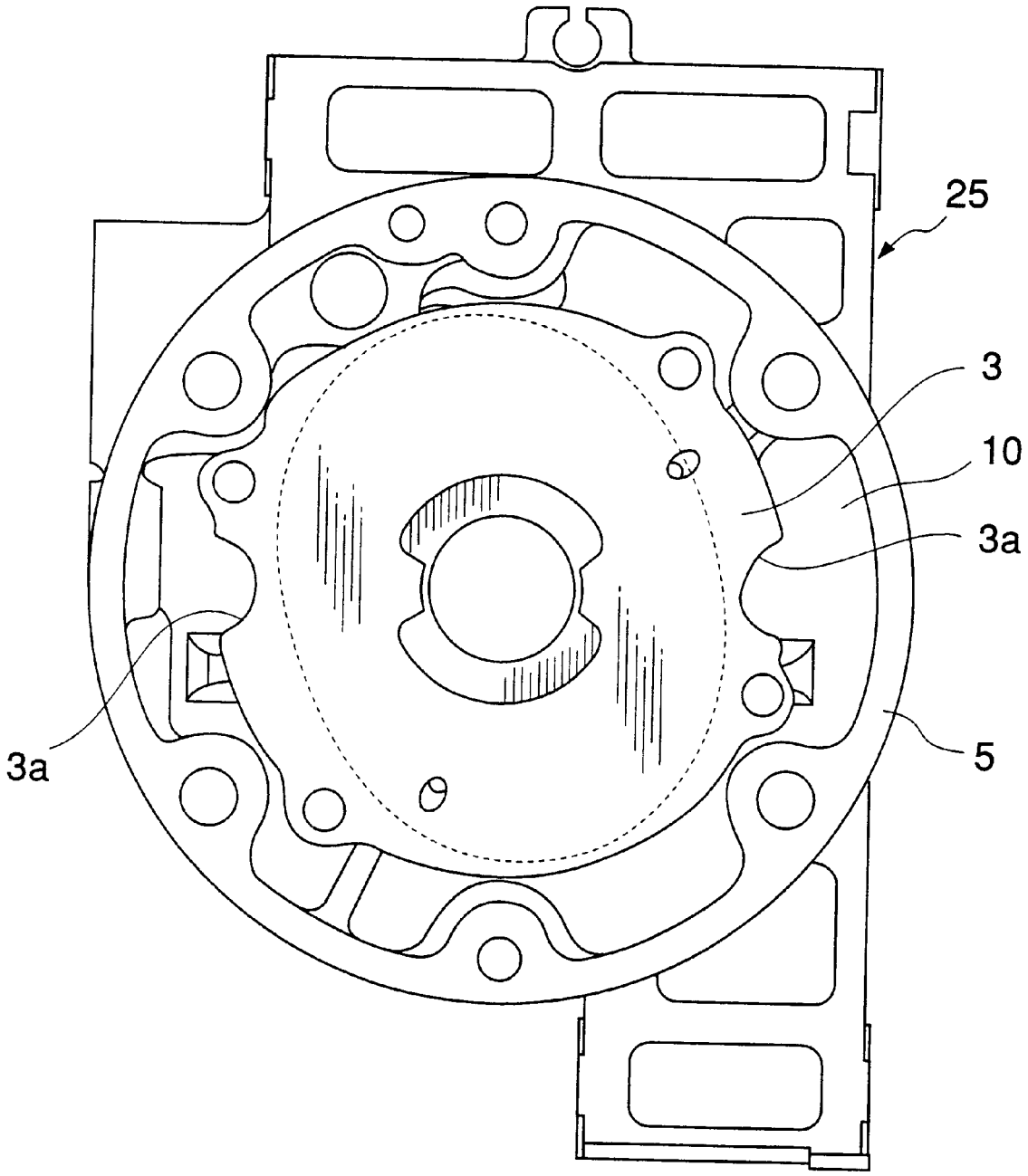
FIG. 2 is an end view of a rear-side end of a front head with a front side block received therein.
Figure 3:
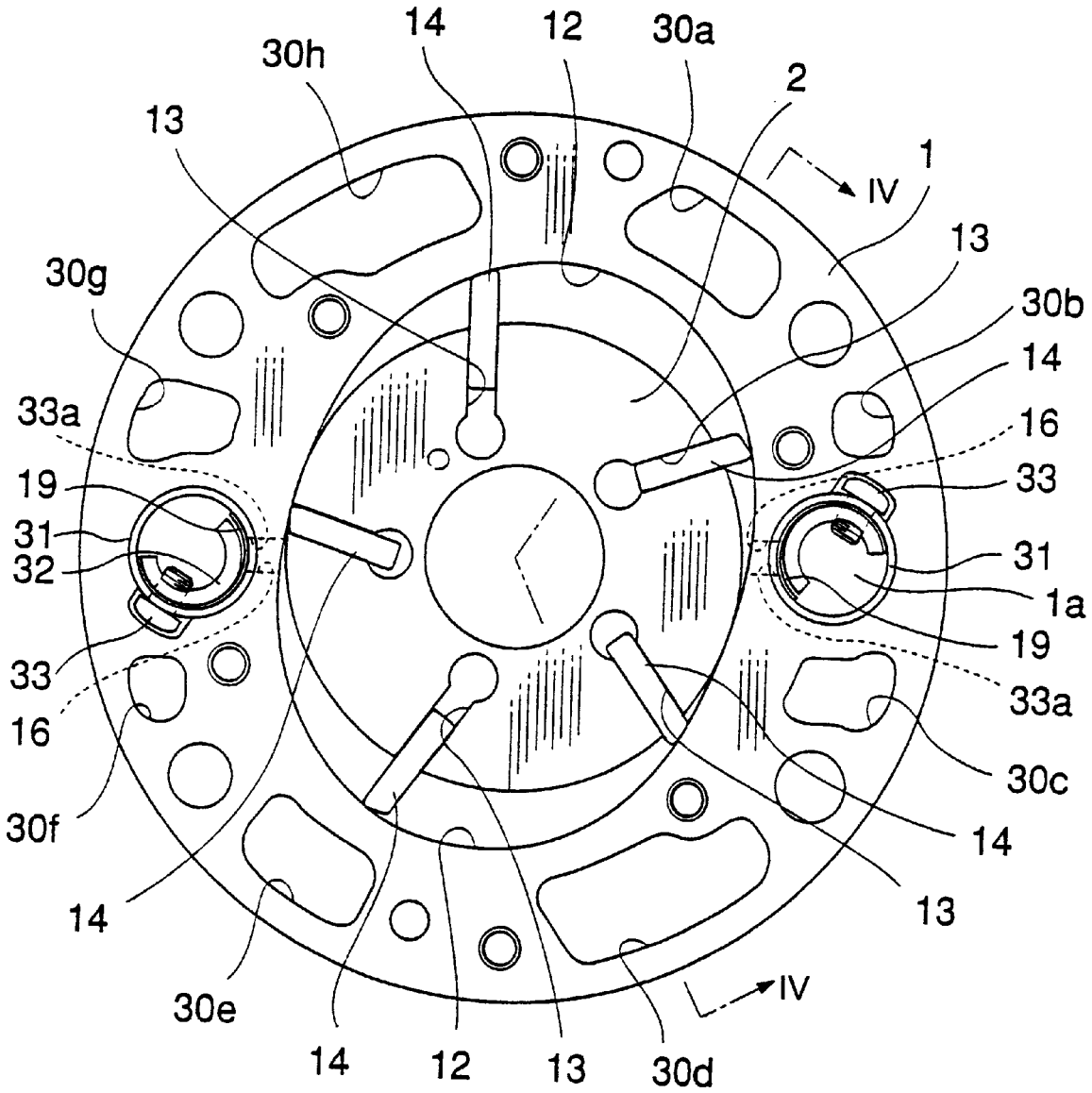
FIG. 3 is an end view of a front-side end of a cam ring.
Figure 4:
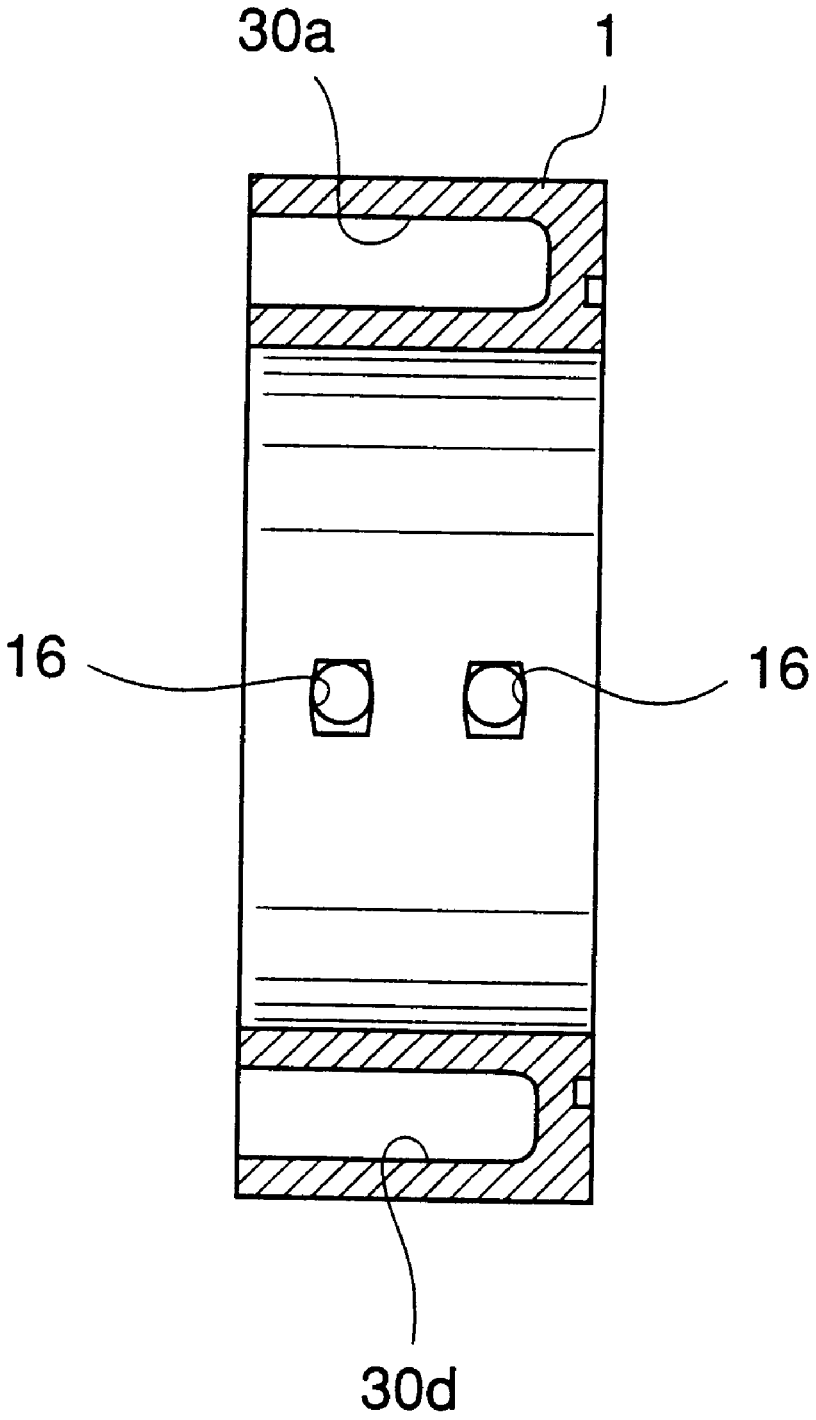
FIG. 4 is a sectional view taken on line IV–IV of FIG. 3.

FIG. 1 shows a vane compressor along the longitudinal axis thereof according to an embodiment of the invention. FIG. 2 shows rear-side end faces of a front head 5 and a front side block 3 received in the front head 5. FIG. 3 shows a front-side end face of a cam ring 1, and FIG. 4 is a sectional view taken on line IV–IV of FIG. 3.

The vane compressor is comprised of the cam ring 1, a front-side member (first side member) 25 and a rear-side member (second side member) 20 arranged on open opposite ends of the cam ring 1, a rotor 2 rotatably received within the cam ring 1, and a drive shaft 7 on which is secured the rotor 2. The drive shaft 7 is rotatably supported by a pair of radial bearings 8 and 9 arranged in the front-side and rear-side members 25 and 20, respectively.

The front-side member 25 is comprised of the front side block 3 which is secured to the front-side end face of the cam ring 1, and the front head 5 which is secured to the front-side end face of the cam ring 1 in a state enclosing the front side block 3.

The front head 5 is formed with a discharge port 5*a* through which high-pressure refrigerant gas is discharged.

The discharge port 5*a* communicates with a discharge chamber (high-pressure chamber) 10 into which flows high-pressure refrigerant gas delivered from compression chambers, referred to hereinafter. The discharge chamber 10 is defined by an inner wall surface of the front head 5, a front-side end face of the front side block 3, and the front-side end face of the cam ring 1. In other words, in the rear-side end face of the front head 5 opens an opening of the discharge chamber 10 (see FIG. 2) which is closed by the front side block 3 and the cam ring 1. Lubricant separated from the refrigerant gas within the discharge chamber 10 collects in a bottom thereof.

The front side block 3 is formed with refrigerant outlet passages 3*a* which communicate respective discharge spaces la formed within the cam ring 1 with the discharge chamber 10.

The rear-side member 20 is formed by a rear head 6 alone, which is secured to the rear-side end face of the cam ring 1 via an O ring 22. The rear head 6 is formed with a suction port 6*a* through which refrigerant gas is drawn into the compressor. The suction port 6*a* communicates with a suction chamber 11 formed within the rear head 6.

The compression spaces 12 in pair are defined by an inner peripheral surface of the cam ring 1 and an outer peripheral surface of the rotor 2, at respective diametrically opposite locations as shown in FIG. 3 (only one of the compression spaces 12 is shown in FIG. 1). The rotor 2 has its outer peripheral surface formed therein with a plurality of axial vane slits 13 at circumferentially equal intervals, in each of which a vane 14 is radially slidably fitted. The compression spaces 12 are divided by the vanes 14 into compression chambers, the volume of each of which is varied with rotation of the rotor 2.

Further, the cam ring 1 is formed therein with the discharge spaces 1*a* to which high-pressure refrigerant gas is delivered from the compression chambers. FIG. 1 shows only one of the discharge spaces 1*a*. Two pairs of refrigerant outlet ports 16, 16 are formed through opposite lateral side walls of the cam ring 1, which separates the discharge spaces 1*a* and the compression spaces 12, in a fashion corresponding to the compression spaces 12 (only one pair of the refrigerant outlet ports 16, 16 is shown in FIG. 1). When the refrigerant outlet ports 16 open, the high-pressure refrigerant gas is delivered from compression chambers via the refrigerant outlet ports 16, and flows into the discharge chamber 10 through the discharge spaces la and the refrigerant outlet passage 3*a*.

Each discharge space 1*a* accommodates a hollow cylindrical valve holder 31 which is provided with a discharge valve 19 and a valve stopper 32 for holding the discharge valve 19 from inside. The discharge valve 19 and the valve stopper 32 are both in an arcuate form and fixed to the valve holder 31 by two fixing bolts 33, 33. The valve holder 31 has a pair of through holes 33*a*, 33*a* formed therethrough in a fashion corresponding to the refrigerant outlet ports 16, 16, respectively.

Refrigerant inlet ports, not shown, are formed in the rear-side end face of the cam ring 1, and refrigerant gas is supplied from the suction chamber 11 to the respective compression chambers via the inlet ports.

Eight high-pressure spaces 30*a* to 30*h* open in predetermined portions of the front-side end face of the cam ring 1 which correspond to the opening of the discharge chamber 10 formed in the rear-side end face of the front head 5 such that the high-pressure spaces 30*a* to 30*h* each directly communicate with the discharge chamber 10. As shown in FIG. 4, the high-pressure spaces 30*a* to 30*h* extend longitudinally deep into the lateral walls of the cam ring 1 from the predetermined portions of the front-side end face thereof toward the rear side.

Next, the operation of the vane compressor constructed as above will be explained.

As torque is transmitted from an engine, not shown, to the drive shaft 7, the rotor 2 is driven for rotation. Refrigerant gas flowing out of a refrigerant outlet port of an evaporator, not shown, is drawn into the suction chamber 11 via the suction port 6*a*. The refrigerant gas is drawn into the compression spaces 12 from the suction chamber 11 via the refrigerant inlet ports.

The compression spaces 12 are divided by the vanes 14 into five compression chambers, each of which is varied in capacity with rotation of the rotor 2, whereby refrigerant gas trapped in each compression chamber is compressed, and the compressed refrigerant gas opens the discharge valves 19, 19 to flow out via the refrigerant outlet ports 16, 16 into the discharge space 1*a*.

The high-pressure refrigerant gas flowing into the discharge spaces la further flows into the discharge chamber 10 through the refrigerant outlet passages 3*a*, followed by being discharged via the discharge port 5*a*. The refrigerant gas which has flowed into the discharge chamber 10 undergoes separation of oil (lubricant), and lubricant separated from the refrigerant gas collects in the bottom of the discharge chamber 10.

The high-pressure spaces 30*a* to 30*h*, which are formed in the front-side end face of the cam ring 1 as described above, directly communicate with the discharge chamber 10, and hence they serve as respective extended portions of the discharge chamber 10.

According to the above embodiment, the volume or capacity of the discharge chamber 10 is increased by a total volume of the high-pressure spaces 30*a* to 30*h* as extended portions of the discharge chamber 10, which makes it possible to increase the capacity of the discharge chamber 10 without increasing the size of the front head 5, to thereby enhance oil-separating capability of the discharge chamber of the compressor and reduce high-pressure pulsation. Conversely, it is possible to reduce the size of the front head 5 without decreasing capacity of the discharge chamber 10.

Further, provision of the high-pressure spaces 30*a* to 30*h* decreases thick portions of the cam ring 1 in number and volume, and at the same time facilitates production of a multi-cavity mold which permits a plurality of cam rings to be manufactured at one time by die-casting.

Still further, it should be noted that differently from a conventional method of achieving the light weight of a cam ring, in which so-called lightening holes are formed in an outer peripheral wall surface of the cam ring, according to the present embodiment, the cam ring 1 is lightened or thinned by forming spaces (i.e. the high-pressure spaces 30*a* to 30*h*) therein, so that rigidity thereof is enhanced.

It is further understood by those skilled in the art that the foregoing is the preferred embodiment of the invention, and that various changes and modifications may be made without departing from the spirit and scope thereof.

What is claimed is:

1. A vane compressor comprising:

a rotor having vanes, a cam ring in which the rotor is rotatably received, a first side member secured to a first end face of said cam ring, a second side member secured to a second end face of said cam ring, a high-pressure chamber formed within said first side member, a discharge space, formed in said cam ring and opening in said first end face of said cam ring, for guiding a high-pressure refrigerant gas discharged into said discharge space via a refrigerant outlet port in said cam ring into said high-pressure chamber, a discharge valve for said refrigerant outlet port, said discharge valve being accommodated within said discharge space, and at least one high-pressure space formed in said cam ring which opens in said first end face of said cam ring in a manner such that said at least one high-pressure space directly communicates only with said high-pressure chamber.

2. The vane compressor according to claim 1, wherein:

said first side member comprises a side block and a head secured to said first end face of said cam ring in a manner such that said head encloses said side block, said high-pressure chamber is formed in said head in a manner such that said high-pressure chamber opens toward said cam ring to form an opening in a cam-ring side end face of said head, and said at least one high-pressure space is formed in said cam ring such that said at least one high-pressure space opens in portions of said first end of said cam ring which correspond in position to said opening of said high-pressure chamber.

3. The vane compressor according to claim 1, wherein said at least one high-pressure space comprises a plurality of high-pressure spaces formed in said cam ring at circumferentially-spaced intervals.

4. The vane compressor according to claim 2, wherein said at least one high-pressure space comprises a plurality of high-pressure spaces formed in said cam ring at circumferentially-spaced intervals.

* * * * *